United States Patent [19]

Garthaffner et al.

[11] Patent Number: 5,024,242

[45] Date of Patent: Jun. 18, 1991

[54] METHODS AND APPARATUS FOR MAKING MULTIPLE COMPONENT SMOKING ARTICLES

[75] Inventors: Martin T. Garthaffner, Midlothian; Billy J. Keen, Jr., Chesterfield; Andrew J. Gillespie; Jack C. Wheless, both of Richmond; George W. Dingus, Cartersville, all of Va.

[73] Assignee: Philip Morris Incorporated, New York, N.Y.

[21] Appl. No.: 343,732

[22] Filed: Apr. 27, 1989

[51] Int. Cl.[5] ..... A24C 5/60

[52] U.S. Cl. ..... 131/94; 131/77; 131/280

[58] Field of Search ..... 131/84.1, 84.2, 84.3, 131/84.4, 94, 280, 58, 59, 77

[56] References Cited

U.S. PATENT DOCUMENTS

| | | | |
|---|---|---|---|
| 2,649,761 | 8/1953 | Edwards . | |
| 2,809,639 | 10/1957 | Edwards . | |
| 2,809,640 | 10/1957 | Oldenkamp . | |
| 3,052,164 | 9/1962 | Rowlands . | |
| 3,081,778 | 3/1963 | Dearsley . | |
| 3,118,454 | 1/1964 | Rowlands . | |
| 3,131,612 | 5/1964 | Rowlands . | |
| 3,473,536 | 10/1969 | Oesterling et al. . | |
| 3,506,017 | 4/1970 | Schubert | 131/94 |
| 3,834,285 | 9/1974 | Schubert et al. . | |
| 3,915,176 | 10/1975 | Heitmann et al. | 131/84.3 |
| 3,961,633 | 6/1976 | Schubert et al. . | |
| 4,036,119 | 7/1977 | Schubert et al. . | |
| 4,301,816 | 11/1981 | Wahle et al. . | |
| 4,605,014 | 8/1986 | Wahle . | |

FOREIGN PATENT DOCUMENTS

| | | | |
|---|---|---|---|
| 33852 | 11/1964 | German Democratic Rep. | 131/94 |

*Primary Examiner*—V. Millin

*Attorney, Agent, or Firm*—Robert R. Jackson

[57] ABSTRACT

Relatively fragile components for cigarette-like smoking articles are wrapped with an overwrap by bringing an exposed axial surface portion of the component into resilient contact with the overwrap, and by then rolling the component about its longidudinal axis, again by resiliently contacting the component. Smoking articles including the foregoing components as the distal component and at least one other proximal component are made by supplying a pair of distal components with their distal ends facing one another and pushed up against an interposed stop. The overwrap is slit parallel to the stop just prior to application to the distal components. After overwrapping, the distal components are reoriented so that their distal ends face away from one another. A pair of proximal components is then placed between the distal components, and each proximal component is joined to the adjacent distal component by a tipping overwrap.

41 Claims, 8 Drawing Sheets

METHODS AND APPARATUS FOR MAKING MULTIPLE COMPONENT SMOKING ARTICLES

BACKGROUND OF THE INVENTION

This invention relates to methods and apparatus for making multiple-component smoking articles, especially such articles having at least one component which is relatively rigid and/or brittle and which therefore cannot be processed in the same way that the usual relatively elastic components of smoking articles are processed.

There is growing interest in rodlike smoking articles in which the tobacco is not burned but is merely heated to cause it to release its flavors. One possible construction of such smoking articles comprises (1) a distal heat and flavor generator, (2) a proximal portion including a plug of filter material at the extreme proximal end and possibly a short tobacco segment on the distal side of the filter plug, and (3) a hollow tube interconnecting the distal and proximal components. All of these components are typically cylindrical, coaxial, and of approximately the same outer diameter. One or more outer wrappings (e.g., of paper or the like) are used to hold all of these components together and/or to give the finished article the external appearance of a conventional smoking article (e.g., a conventional cigarette).

Among the possible heat generators for smoking articles of the type described above are generators which comprise a perforated aluminum tube containing a combustible carbon rod. Unlike most prior smoking article components, such tubes containing carbon rods are radially relatively rigid and fragile. This means that smoking articles including such tubes cannot be assembled by passing them through a garniture which relies on radial compressibility of the components being processed. It also means that excessive radially directed force must not be used at any time during the assembly of smoking articles including such tubes because of the danger that the tube will collapse or lose its roundness and/or that the carbon rod will break.

Another problem associated with assembling smoking articles including an aluminum tube containing a carbon rod is that it would be extremely difficult or impossible to cut the smoking article transversely in the vicinity of the tube. On the other hand, it is highly desirable to have the distal end of the overwrap completely cover the distal end of the tube with no excess overwrap extending beyond the distal end of the tube. If the overwrap is too short (i.e., if it does not completely cover the tube), the product may not have an acceptable appearance. If the overwrap is too long (i.e., if it extends beyond the distal end of the tube), the excess overwrap may flame up unacceptably when the product is lit by the consumer. Yet the difficulty or impossibility of cutting the smoking article transversely adjacent to the tube makes it extremely difficult to achieve precise alignment of the distal end of the overwrap with the distal end of the tube.

Although perforated aluminum tubes have been referred to for convenience in the foregoing discussion, it will be apparent that tubes of other metals or materials are also possible and would present similar problems. For example, the tube could be a hollow ceramic tube.

In view of the foregoing, it is an object of this invention to provide methods and apparatus for assembling smoking articles of the type described above.

It is a more particular object of the invention to provide methods and apparatus for assembling smoking articles including radially rigid and/or fragile components which avoid the use of excessive radial force during assembly of the articles.

It is another more particular object of this invention to provide methods and apparatus for more precisely aligning the edge of a smoking article overwrap with the end of the smoking article component being overwrapped without the need to cut the smoking article transversely adjacent that end after it has been overwrapped.

SUMMARY OF THE INVENTION

These and other objects of the invention are accomplished in accordance with the principles of the invention by providing methods and apparatus for assembling multiple component smoking articles in which, to precisely align the edge of an overwrap with the end of the smoking article, that end of the smoking article is pushed axially against a stop (preferably by an axially resilient structure which avoids excessive axial force on the smoking article). The overwrap material is slit by a knife aligned with the stop and located as close to the stop as possible so that the overwrap is fed to the smoking article with its slit edge precisely aligned with the end of the smoking article against the stop. To avoid excessive radial force on the smoking article during overwrapping, either the smoking article or the overwrap or both are resiliently supported parallel to the radius of the smoking article as the smoking article and overwrap are initially brought into contact with one another. The pressure applied by this resilient supporting structure is great enough to cause the overwrap to adhere to the smoking article (e.g., by virtue of adhesive on the overwrap and/or the smoking article), but not great enough to damage the smoking article. The radial pressure on the smoking article is further reduced (and adhesion of the overwrap enhanced) by making the portion of the overwrap-supporting member concave at the point where the overwrap initially contacts the smoking article. After "tagging" the smoking article with the overwrap as described above, the smoking article is then rolled by contact with at least one resilient member (e.g., a resilient belt) to wrap the overwrap completely around the smoking article, again without applying excessive radial force to the smoking article.

To increase speed and efficiency and to reduce waste, the methods and apparatus of this invention allow two smoking articles to be assembled in parallel. The distal ends of two smoking articles are pressed up against respective opposite sides of the above-mentioned stop, which is preferably made very thin so that the overwrap on each side of the above-mentioned knife can be applied to a respective one of the two smoking articles with the slit edge of the overwrap precisely aligned with the distal end of the associated smoking article. In the preferred embodiment, the tobacco and filter are added after the foregoing steps. In that case, the partially assembled smoking articles from the foregoing steps are preferably reversed so that their distal ends are remote from one another. A double-length filter plug with a tobacco plug at each end is then positioned between the two smoking article subassemblies. A tipping overwrap is then applied to join all of the foregoing components together, after which the filter is bisected transversely to produce two finished smoking articles.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
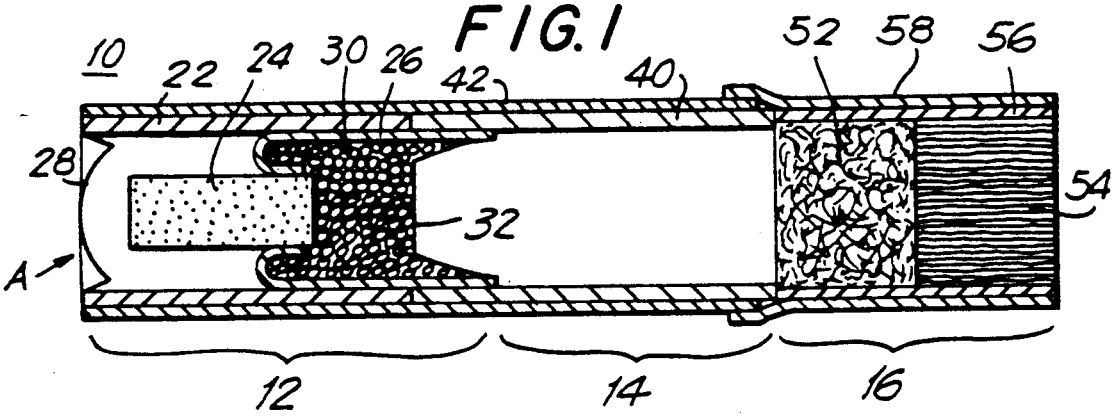
FIG. 1 is a simplified longitudinal sectional view of a cigarette-like smoking article of a type which can be advantageously made using the methods and apparatus of this invention.

FIG. 1 shows one type of smoking article 10 which can be made in accordance with the principles of this invention, although it will be understood that smoking article 10 is merely illustrative and that the invention is equally applicable to making smoking articles having many other constructions. The exact details of smoking article 10 are not essential to the present invention and are only described in general terms herein as background. Additional information regarding smoking article 10 is contained in commonly assigned, co-pending U.S. patent application Ser. No. 07/223,153 (Docket PM 1322) which is hereby incorporated by reference herein.

Smoking article 10 includes a distal heat and flavor generator portion 12, a hollow tubular intermediate portion 14, and a proximal portion 16 including tobacco plug 52 and filter plug 54. Heat and flavor generator 12 includes perforated aluminum tube 22 in which combustible carbon rod 24 is supported by resilient support 26, also preferably of aluminum. (Although elements 22 and 26 are referred to for convenience herein as aluminum, they may actually be laminates of aluminum and other materials such as paper. These details are of no consequence to the present invention, however, and so need not be discussed herein.) The distal end A of heat and flavor generator 12 is partially closed by a perforated metal cap 28 (e.g., of stainless steel or aluminum) which serves as a reflector to help maintain combustion of carbon rod 24 after the smoking article has been lit. Pellets 30, typically comprising a mixture of tobacco, glycerin, and possibly other ingredients such as flavorants, are disposed in heat and flavor generator 12 proximally of carbon rod 24 for releasing the desired flavors, etc., when heated by the hot gaseous combustion product of carbon rod 24. Pellets 30 are held in place by perforated metal grating 32.

The principal component of intermediate portion 14 is hollow paper tube 40 which is pressed onto the proximal end of heat generator 12. Distal and intermediate portions 12 and 14 are overwrapped by paper overwrap 42 which helps to hold these portions together and gives them a unitary appearance.

Proximal portion 16 includes proximal filter 54 and distal tobacco plug 52 initially joined together by plug wrap 56. Tipping overwrap 58 secures proximal portion 16 to the remainder of smoking article 10.

Smoking article 10 is consumed by lighting carbon rod 24 (e.g., with a match or lighter flame held just outside cap 28) and then drawing the hot gaseous combustion product of the carbon rod through pellets 30, tobacco plug 52, and filter plug 54. The hot gas passing through pellets 30 causes tobacco flavor to be released without any actual combustion of the tobacco. The consumer has the sensation of smoking a cigarette but receives no tobacco smoke.

Figure 2:
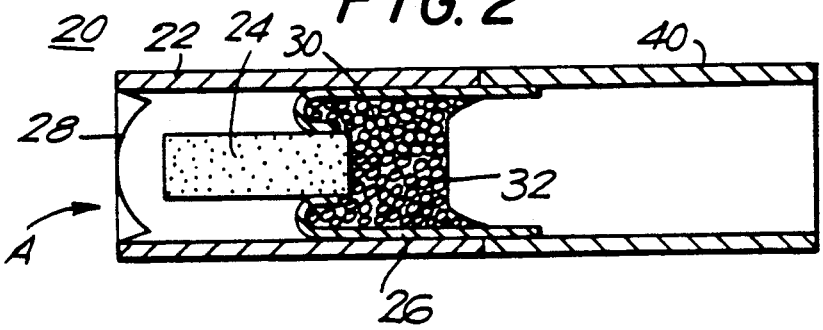
FIG. 2 is a simplified longitudinal sectional view of a portion of the smoking article of FIG. 1.
Figure 3:
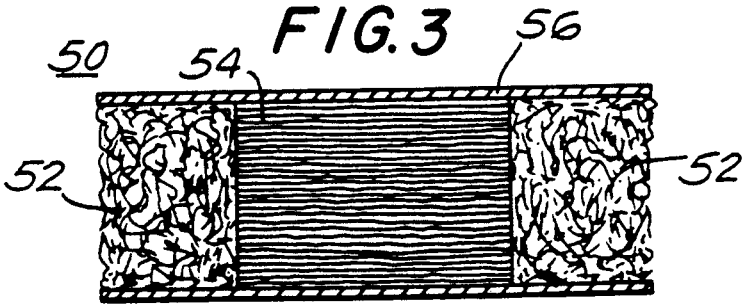
FIG. 3 is a simplified longitudinal sectional view of another portion of the smoking article of FIG. 1.

The starting components for the present invention are subassemblies 20 and 50, shown respectively in FIGS. 2 and 3. Subassembly 20 includes all of distal and intermediate components 12 and 14 except overwrap 42. Subassembly 50 is a double-length proximal portion 16 minus tipping overwrap 58. In particular, subassembly 50 includes a double-length filter plug 54 with a tobacco plug 52 at each end. The present invention relates to methods and apparatus for applying overwrap 42 to subassembly 20, and for then adding proximal component 16 to that structure.

It is much more difficult to apply overwrap 42 to subassembly 20 than to conventional smoking article components because subassembly 20 is relatively fragile in the radial direction. Subassembly 20 is susceptible to plastic deformation of tube 22 or to brittle fracture of carbon rod 24 if subjected to radial forces of the magnitude which are readily absorbed with no adverse consequences by conventional smoking article components. This means, for example, that subassemblies 20 cannot be overwrapped by passing them through a garniture. It is also not possible to cut through a smoking article adjacent subassembly 20. This increases the difficulty of precisely aligning the distal end of tube 22 with the distal end of overwrap 42. Another respect in which subassemblies 20 differ from conventional smoking article components is that subassemblies 20 are relatively inelastic in the axial direction. This makes it difficult or impossible to use conventional swash plate apparatus for pushing subassemblies 20 into desired axial positions. The methods and apparatus of this invention overcome all of these difficulties, and in addition provide extremely efficient ways of assembling finished smoking articles from components like those shown in FIGS. 2 and 3.

Figure 4:
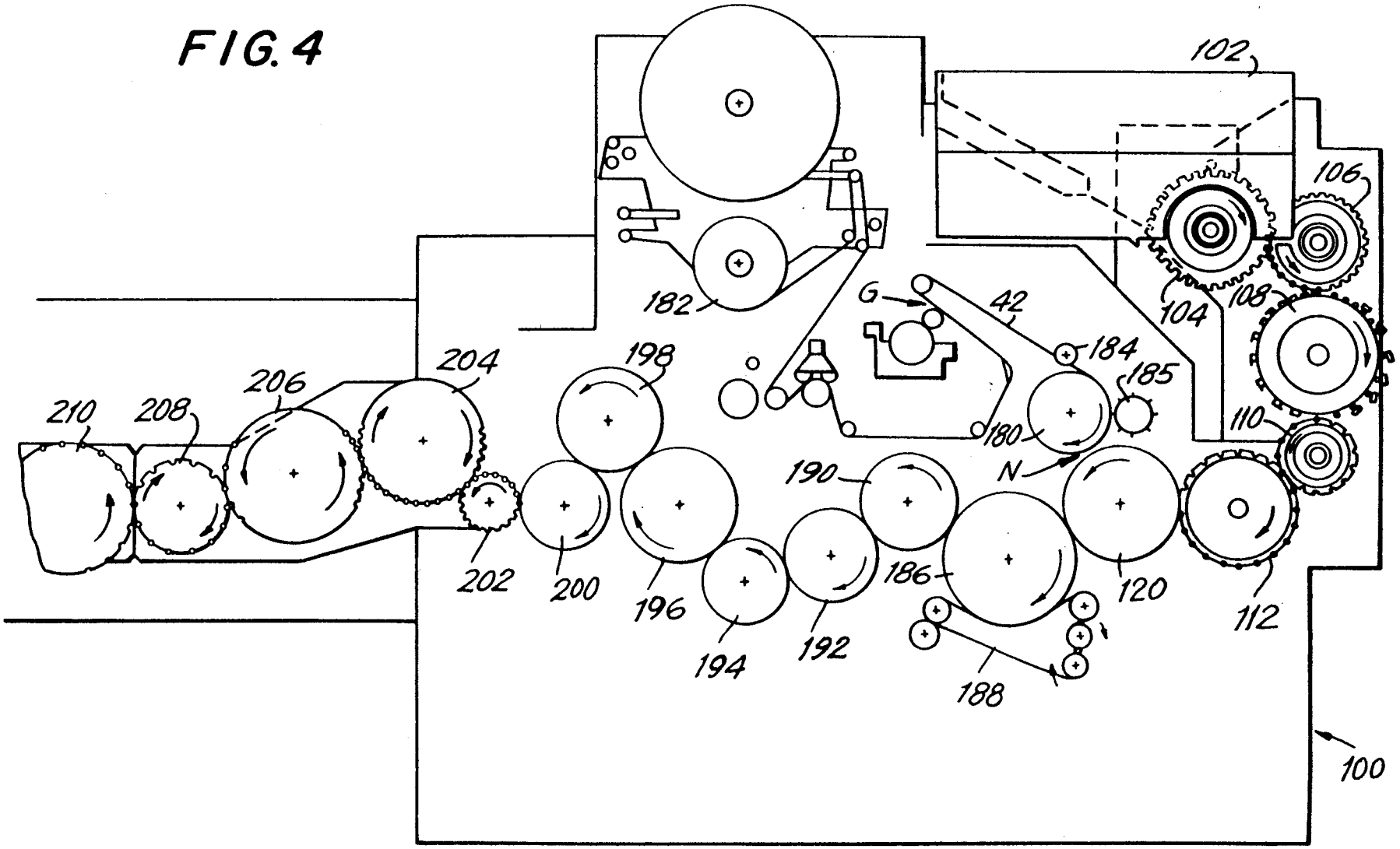
FIG. 4 is a simplified elevational view of apparatus constructed in accordance with this invention for performing some of the steps involved in making smoking articles of the type shown in FIG. 1 in accordance with this invention.
Figure 5:
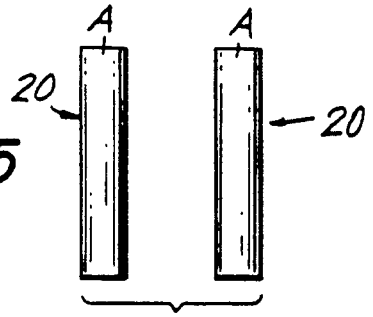
FIG. 5 shows the contents of two successive flutes, for example, on drum 106 in FIG. 4.
Figure 6:
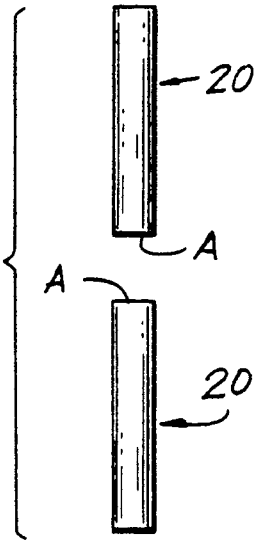
FIG. 6 shows the contents of one flute, for example, on drum 110 in FIG. 4.

As shown in FIG. 4, the first part of the apparatus of this invention applies overwrap 42 to subassemblies 20. This apparatus can be a conventional tipper 100 (e.g., a MAX S model tipper available from Hauni-Werke Korber & Co. KG of Hamburg, West Germany (hereinafter "Hauni")) modified as described below. Subassemblies 20 are supplied to tipper 100, for example, from a tray (not shown) removably positioned on hopper 102. All of subassemblies 20 are initially oriented so that their distal ends A face away from the side of tipper 100 which is visible in FIG. 4. Subassemblies 20 are picked up from hopper 102 one after another by fluted transport drum 104 which may be conventional. Drum 104 passes subassemblies 20 one after another to conventional fluted transfer drum 106, which in turn passes them to conventional tip turner 108. At the top of tip turner 108, successive subassemblies are oriented as shown in FIG. 5. As is conventional, tip turner 108 reorients every other one of subassemblies 20 and axially aligns each reoriented subassembly with the adjacent unreoriented subassembly so that at the bottom of tip turner 108 the subassemblies of FIG. 5 are oriented and aligned as shown in FIG. 6. In particular, the distal ends A of two subassemblies 20 are facing one another in FIG. 6. Tip turner 108 passes each such pair of axially aligned subassemblies to one flute of conventional transfer drum 110. From drum 110, the subassembly pair is passed to conventional transfer drum 112 and thence to drum 120.

Figure 7:
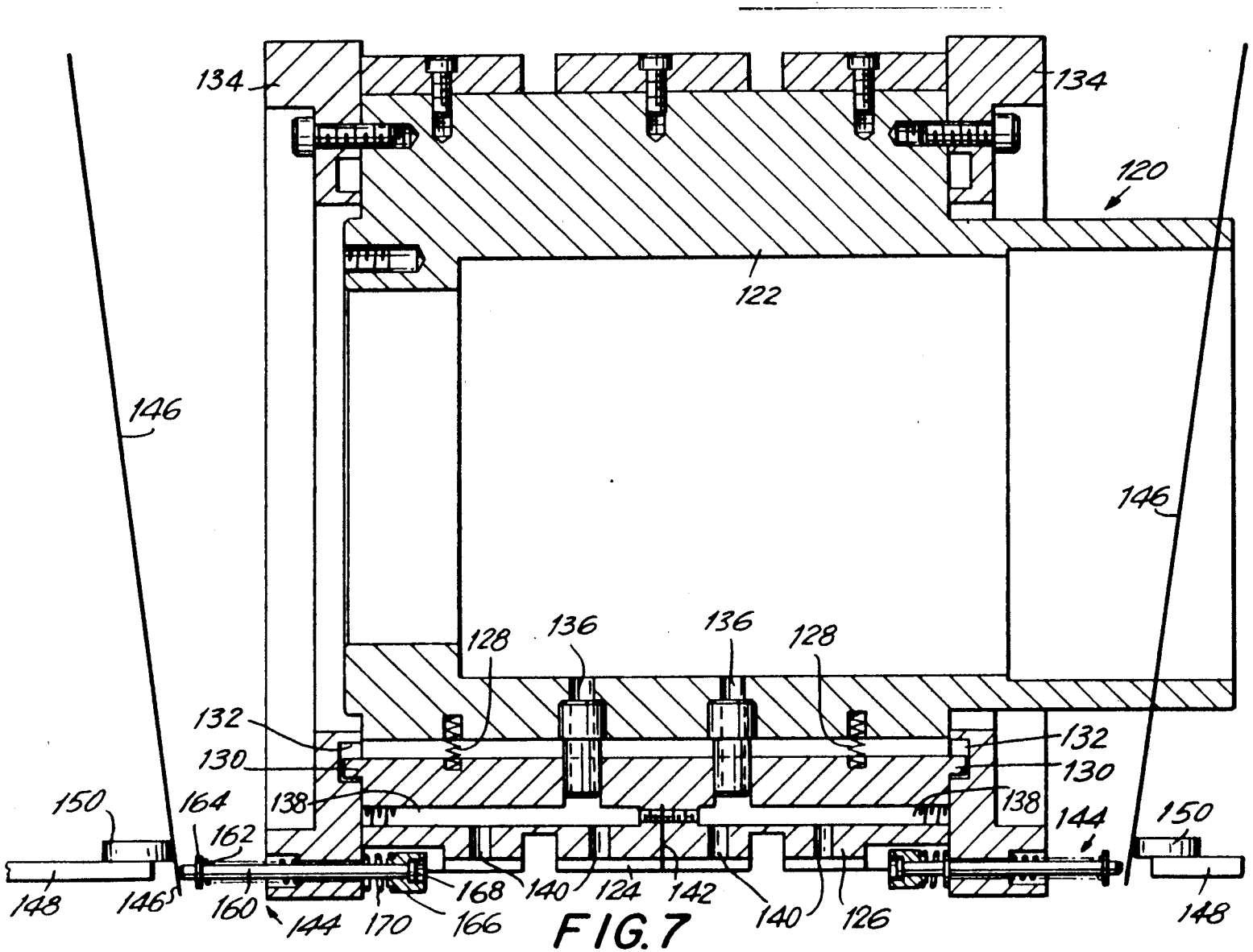
FIG. 7 is a simplified longitudinal sectional view of drum 120 and associated apparatus in FIG. 4.

Drum 120 has several special features in accordance with this invention and is therefore shown in more detail in FIG. 7. Drum 120 includes a hollow core 122, which is supplied with a partial vacuum in the conventional manner for holding subassemblies 20 to the flutes on the drum. To avoid excessive radial force on subassemblies 20 when those subassemblies are tagged with overwrap 42 as described below, each flute 124 on drum 120 is disposed in a member 126 which is mounted on core 122 so that the member 126 can move resiliently radially inwardly relative to core 122. In particular, each member 126 is resiliently urged radially outwardly relative to core 122 by a pair of compression coil springs 128. The outward motion of each member 126 is stopped by stops 130 which extend into annular channels 132 in rings 134 which are respectively mounted on the axially opposite ends of drum 120. Vacuum from the interior of core 122 is conveyed to each flute 124 via communicating passageways 136, 138, and 140. Each flute is transversely bisected by a thin metal stop 142. Transfer drum 112 deposits a pair of subassemblies 20 in each flute 124 so that one subassembly is on each side of stop 142.

Prior to tagging subassemblies 20 with overwrap 42 as described below, the adjacent distal ends A of the subassemblies are pushed firmly against the respective opposite sides of stop 142 to ensure proper alignment of the slit edges of overwrap 42 with distal ends A. Because, as has been mentioned, sub-assemblies 20 are axially relatively inelastic, normal swash plate apparatus cannot be safely used to push subassemblies 20 against rigid stop 142. Accordingly, resilient plungers 144 are used between conventional swash plates 146 and the ends of subassemblies 20 remote from stop 142. (As is conventional, each swash plate 146 rotates with drum 120 and is pressed axially inward toward drum 120 at the point where axial pressure on subassemblies 20 is required by a stationary arm 148 rotatably supporting a roller 150 which is in contact with the associated swash plate. In FIG. 7, elements 146, 148, and 150 are only shown schematically, not in their true operative relationship to the other depicted elements because the true operative relationship is obvious to those skilled in the art and would needlessly complicate the drawing.) Each plunger 144 includes a shaft 160 which passes loosely through a hole in the associated ring 134 so that the shaft can reciprocate axially relative to the hole. Shaft 160 is resiliently urged toward the adjacent swash plate 146 by compression coil spring 162 which acts between the associated ring 134 and a collar 164 carried on the shaft. A cap 166 is loosely mounted on the end of shaft 160 adjacent flute 124. Cap 166 is held on shaft 160 by the enlarged head 168 of the shaft. Cap 166 is resiliently urged against head 168 by compression coil spring 170 acting between ring 134 and cap 166. Swash plate 146 acts on the end of shaft 160 remote from cap 166 to urge shaft 160 and cap 166 to move axially toward stop 142. Cap 166 acts on the adjacent end of a subassembly 20 in flute 124 to push the distal end A of the subassembly firmly against stop 142. Excessive axial force on subassembly 20 is prevented by spring 170 which allows cap 166 to stop moving with shaft 160 as soon as the subassembly contacts stop 142. Thereafter, as drum 120 continues to rotate and swash plate 146 moves away from shaft 160, springs 162 and 170 restore elements 160 and 166 to their initial positions relative to one another and to ring 134. The vacuum applied to flute 124 holds subassemblies 20 in the axial positions established by the other apparatus.

Returning to FIG. 4, drum 112 deposits one subassembly 20 on each side of stop 142 in each flute 124 on drum 120. Thereafter, as drum 120 continues to rotate, the swash plates 146 associated with drum 120 push the distal ends A of subassemblies 20 up against stop 142 as described above before the subassemblies reach the nip N between drum 120 and drum 180. Overwrap 42 is fed to drum 180 from supply reel 182. (The larger reel above reel 182 is more overwrap material that will be used when reel 182 is exhausted.) The width of overwrap 42 coming from reel 182 is nearly equal to the length of two subassemblies 20. At location G glue or adhesive is conventionally applied to one surface of overwrap 42. (Alternatively or in addition, adhesive could be applied to subassemblies 20 prior to nip N.) Thereafter, and preferably as close to nip N as possible, overwrap 42 is bisected longitudinally by knife 184. Knife 184 is aligned with stops 142 on drum 120. The unglued surface of overwrap 42 contacts drum 180 and is held to the surface of that drum in the conventional manner by vacuum. Knife drum 185 conventionally cuts overwrap transversely into segments of the length required to wrap around one subassembly 20. At nip N the leading edge of each overwrap segment 42 contacts a portion of the outer periphery of a subassembly 20 and is tacked to that subassembly by the adhesive on the overwrap. Accordingly, the overwrap segment 42 leaves drum 180 and continues to travel with the associated subassembly 20 on drum 120 until that subassembly is transferred from drum 120 to drum 186. Because of the above-mentioned alignment of knife 184 and stops 142, as well as the close proximity of knife 184 to drum 120, the slit edges of overwrap 42 produced by knife 184 are precisely aligned with the distal ends A of subassemblies 20 as is required to produce an acceptable product.

Figure 8:
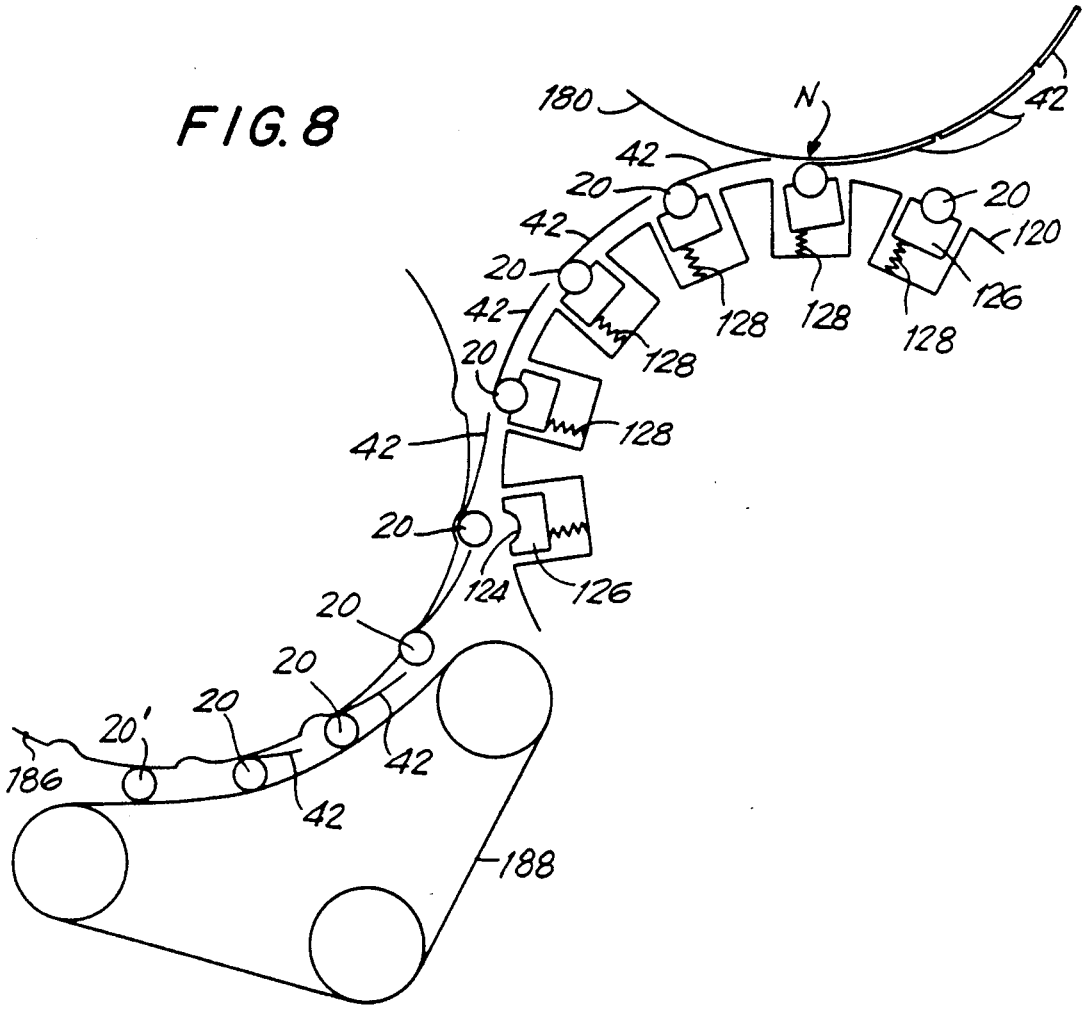
FIG. 8 is an enlarged, partly schematic view of a portion of FIG. 4.

The portion of the operation involving drums 120, 180, and 186 is shown in more detail in FIG. 8. FIG. 8 is particularly of interest in the region of nip N because it is there that the ability of members 126 to move radially inward relative to the remainder of drum 120 is important. Unlike all of the other points at which drums come together in FIG. 4, at nip N there must be some interference between the contents of drums 120 and 180 in order for each overwrap 42 to adhesively adhere to the associated subassembly 20. To avoid excessive radial pressure on subassemblies 20 at that point, springs 128 allow members 126 to move resiliently radially inward of drum 120 as shown in FIG. 8, thereby ensuring that each subassembly 20 is pressed against the associated overwrap 42 with sufficient force to cause overwrap 42 to adhere to the subassembly, but not with such force as could cause damage to the subassembly.

Figure 10:
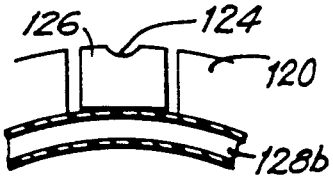
FIGS. 9 and 10 are views similar to a portion of FIG. 8 showing possible alternate constructions of the apparatus.
Figure 9:
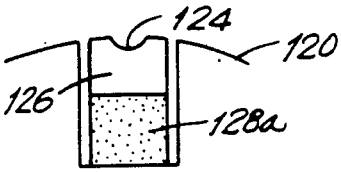

Although in FIGS. 7 and 8 fluted members 126 are resiliently mounted on springs 128, other resilient mounting techniques could be used if desired. For example, in FIG. 9 fluted member 126 is mounted in drum 120 on a block 128*a* of resilient foam rubber. As another example, in FIG. 10 fluted member 126 is mounted in drum 120 on an inflatable diaphragm or cushion 128*b*. This allows the resistance of fluted member 126 to inward displacement to be adjusted by varying the inflation pressure of diaphragm 128*b*.

Figure 11:
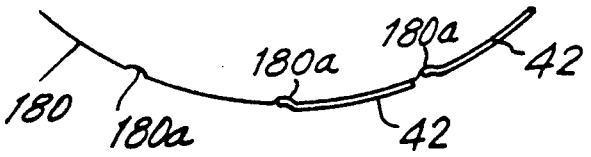
FIG. 11 is a view similar to another portion of FIG. 8 showing another possible alternate construction of the apparatus.

Another technique which can be used in accordance with this invention to reduce the radial pressure on subassemblies 20 at nip N and to improve the initial adhesion of each overwrap 42 to the associated subassembly 20 is to support the leading portion of each overwrap segment in a flute 180*a* in drum 180 as shown in FIG. 11. This increases the area of contact between overwrap 42 and subassemblY 20 at nip N. This in turn increases the adherence of overwrap 42 to subassembly 20, and by spreading out the force applied to subassembly 20, further reduces the risk of damage to that component. In addition, the foregoing work is advantageously done in a range below the pitch diameter of drum 180, so that the resulting relative motion is used to "roll" overwrap 42 onto subassembly 20 when approaching and exiting nip N. Note that the radius of curvature of flutes 180*a* is preferably greater than the radius of curvature of the outer surface of subassembly 20.

As has been mentioned, from drum 120 subassemblies 20 with overwraps 42 partially attached are transferred to fluted drum 186. Drum 186 conveys elements 20 and 42 into contact with belt 188 which is caused to move in the same direction as the adjacent portion of the surface of drum 186 but at a slightly slower speed. Accordingly, the speed difference between elements 186 and 188 causes subassemblies 20 to roll in the direction required to cause overwrap 42 to wrap itself around the associated subassembly (see FIG. 8). Belt 188 is sufficiently resilient that elements 186 and 188 do not apply enough radial force to subassemblies 20 to damage them as they are being rolled.

Figure 12:
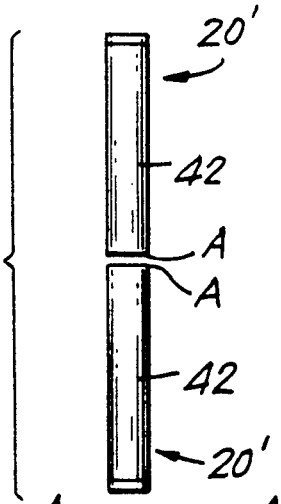
FIG. 12 shows the contents of one flute, for example, on drum 190 in FIG. 4.
Figure 13:
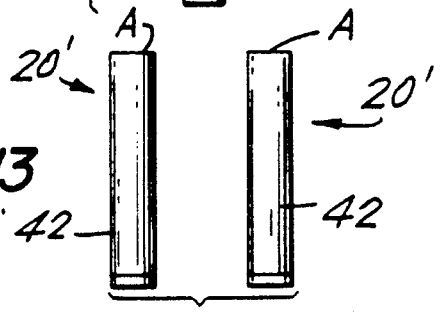
FIG. 13 shows the contents of two successive flutes, for example, on drum 198 in FIG. 4.

After subassemblies 20 have been wrapped with overwrap 42 as described above, drum 186 passes the resulting overwrapped subassemblies 20' to conventional fluted transfer drum 190, which passes them on to conventional fluted transfer drums 192 and 194, and from there to conventional tip turner 196. Tip turner 196 performs an operation that is substantially the reverse of the operation performed by tip turner 108. Accordingly, subassemblies 20' are received by tip turner 196 with the orientation and alignment shown in FIG. 12, and they leave tip turner 196 (for conventional fluted transfer drum 198) as shown in FIG. 13.

Figure 14:
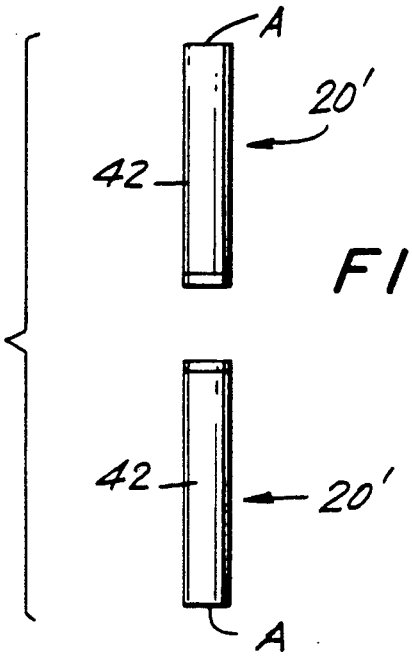
FIG. 14 shows the contents of one flute, for example, on drum 208 in FIG. 4.
Figure 15:
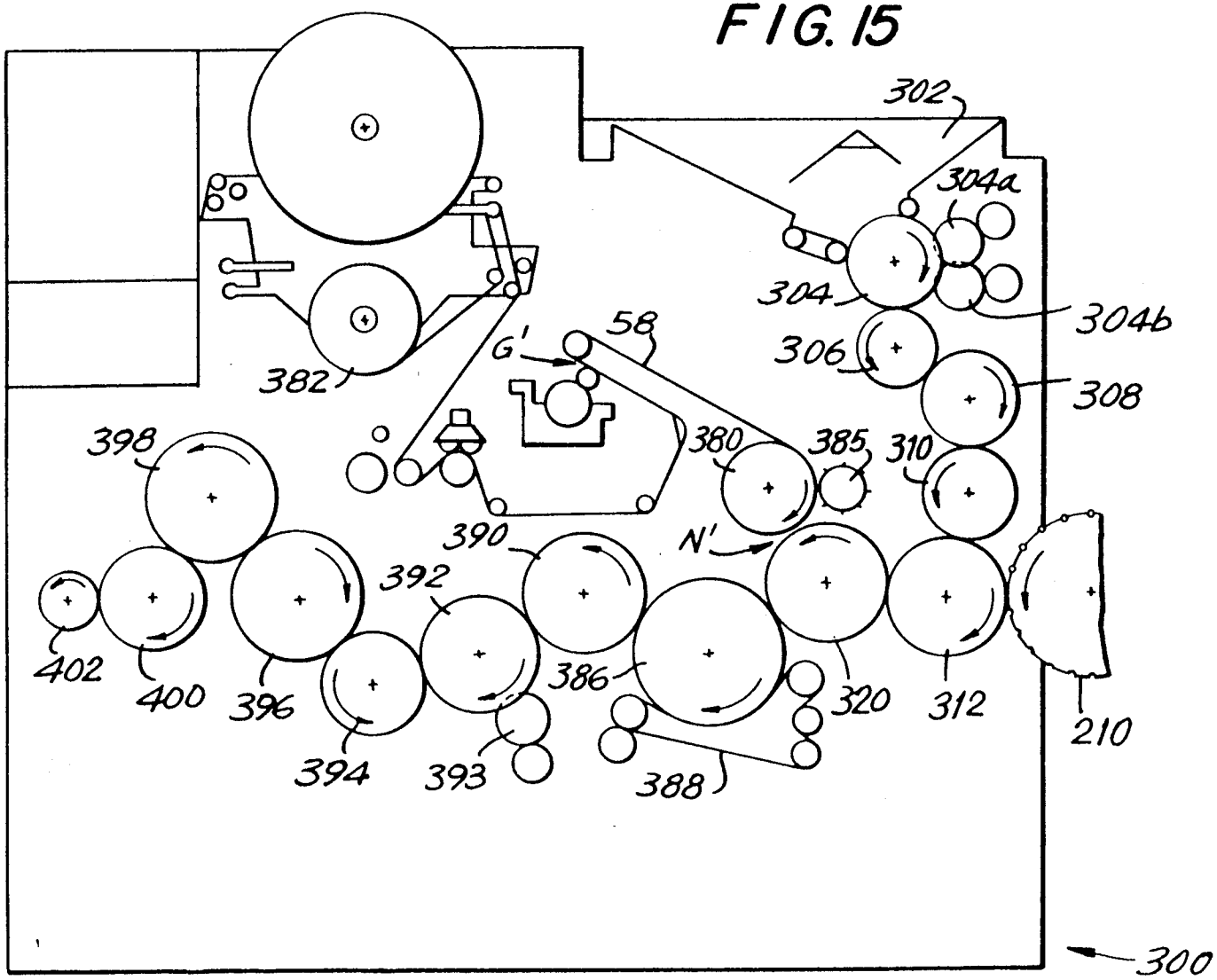
FIG. 15 is a view (similar to FIG. 4) of further apparatus constructed in accordance with this invention for performing further steps involved in making smoking articles of the type shown in FIG. 1 in accordance with this invention.

From tip turner 196, subassemblies 20' continue on via conventional transfer drums 198, 200, 202, and 204 to tip turner 206 with their distal ends A facing away from the side of the machine which is visible in FIG. 4. (Elements 204, 206, 208, and 210 are part of apparatus for conveying subassemblies 20' from tipper 100 to a second tipper 300 (shown in FIG. 15) which completes the fabrication of smoking articles 10 by adding a proximal portion 16 to each subassembly 20' as described in detail below). Tip turner 206, which again may be similar to tip turner 108, receives subassemblies 20' as shown in FIG. 13 and reorients and realigns them as shown in FIG. 14. Accordingly, two successive subassemblies 20' are now coaxial with their distal ends A remote from one another.

From tip turner 206, subassemblies 20' continue on via conventional fluted transfer drums 208 and 210. In the course of traversing these drums, subassemblies 20' are axially separated using conventional means so that the spacing between them will be great enough to accept one subassembly 50 (FIG. 3) between them. In this condition, subassemblies 20' enter tipper 300 (see FIG. 15).

Figure 16:
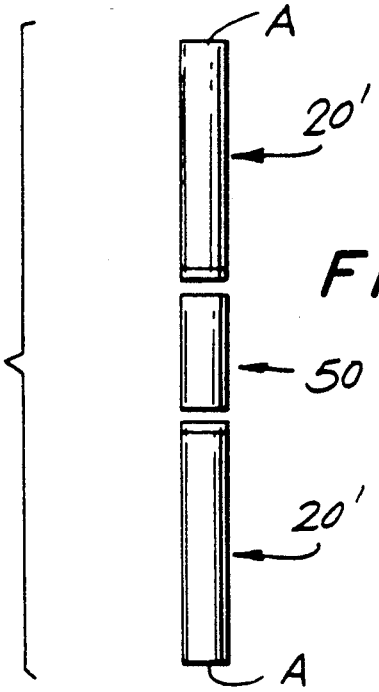
FIG. 16 shows the contents of one flute, for example, on the lower portion of drum 312 in FIG. 15.

Like tipper 100, tipper 300 may be a conventional tipper such as a Hauni MAX S tipper modified as discussed in detail below. Subassemblies 50 are supplied to tipper 300 (e.g., from trays (not shown)) via hopper 302. In the depicted preferred embodiment, subassemblies 50 are initially supplied in triplicate (i.e., three times the length shown in FIG. 3), are picked up from hopper 302 by drum 304, and are twice cut transversely by knives 304*a* and 304*b* to produce subassemblies 50 exactly as shown in FIG. 3. Conventional drums 306, 308, and 310 conventionally transport each subassembly 50 to drum 312 and align it with the gap between a pair of subassemblies 20' conveyed to drum 312 via drum 210. Accordingly, after passing drum 210, each flute on drum 312 contains an array of subassemblies like that shown in FIG. 16.

Figure 17:
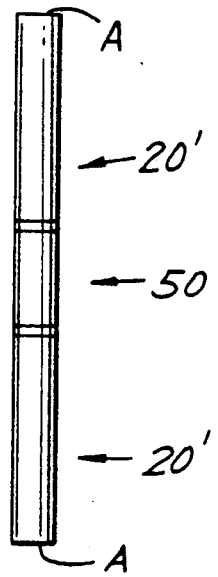
FIG. 17 shows the contents of one flute, for example, on drum 320 Just prior to nip N' in FIG. 16.

From drum 312 each group of subassemblies is transferred to drum 320 where, by means of swash plates, the subassemblies in each flute are axially pushed together as shown in FIG. 17 prior to reaching the nip N' between drums 320 and 380. Although drum 320 could be constructed similarly to drum 120, that is not necessary in the depicted embodiment because the tipping overwrap 58 applied at nip N' does not extend to the radially fragile distal portions 12 of the subassemblies being worked on. Similarly, while the special plunger assemblies shown in FIG. 7 could be used on drum 320 to protect the subassemblies on that drum from excessive axial pressure from the associated swash plates, that is also not necessary in the depicted embodiment because subassemblies 50 are sufficiently axially elastic to prevent excessive axial stress on subassemblies 20'.

Figure 18:
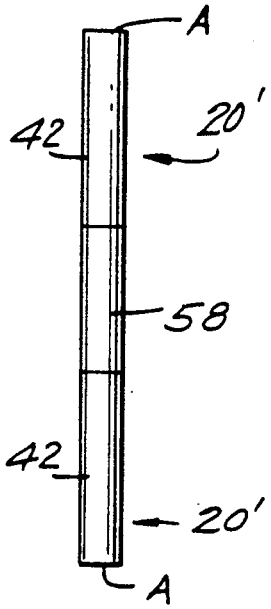
FIG. 18 shows the contents of one flute, for example, on drum 390 in FIG. 16.
Figure 19:
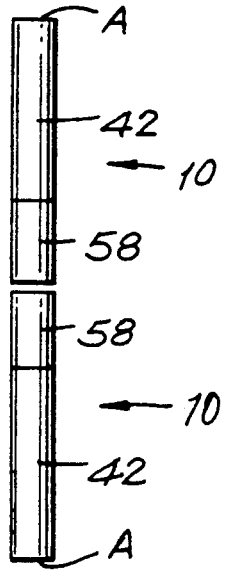
FIG. 19 shows the contents of one flute, for example, on drum 394 in FIG. 16.

At nip N' each group of subassemblies on drum 320 is tagged with the leading edge of a tipping overwrap segment 58 from drum 380 in a manner similar to the tagging of subassemblies 20 with overwrap 42 at nip N in FIG. 4. Tipping overwrap 58 is supplied from supply reel 382, glued on one side at location G', and cut transversely by knife drum 385. From drum 320 the tagged subassemblies are passed to drum 386 which cooperates with belt 388 (in a manner similar to the cooperation of elements 186 and 188 in FIGS. 4 and 8) to wrap tipping overwrap 58 around the associated group of subassemblies. The resulting article (shown in FIG. 18) is a double-length smoking article. This double-length article is passed to drum 392 via drum 390 where it is axially bisected by knife 393 as shown in FIG. 19 to produce two finished single-length smoking articles 10.

From drum 392 the finished smoking articles 10 are conveyed to tip turner 396 via drum 394. Tip turner 396 conventionally reorients one of each pair of finished smoking articles 10 so that all of the articles have the same orientation. The finished articles are then conveyed out of the apparatus via drums 398, 400, and 402.

It will be understood that the foregoing is merely illustrative of the principles of this invention, and that various modifications can be implemented by those skilled in the art without departing from the scope and spirit of the invention. For example, although the invention has been illustrated in the context of its application to the manufacture of smoking articles having a particular construction, it will be understood that the invention is equally applicable to making smoking articles having many other configurations but having one or more components that are relatively fragile radially, axially, or both radially and axially.

The invention claimed is:

1. Apparatus for making smoking articles having at least one substantially cylindrical component having a longitudinal axis and a finite length, said component being radially relatively rigid but fragile and requiring circumferential wrapping with a web-like overwrap which is separately supplied to said apparatus, said apparatus comprising:

means for supporting and transporting said component toward said overwrap in a direction perpendicular to the longitudinal axis of said component so that an axial portion of the outer surface of said component is initially exposed; and means for supporting and transporting said overwrap toward said component in a direction perpendicular to the longitudinal axis of said component so that at least a portion of one of the web-like surfaces of said overwrap is initially exposed and so that said initially exposed portions of said component and said overwrap contact one another, at least one of said means for supporting and transporting being resiliently movable at the initial location of said contact (1) along an axis normal to the portion of the outer surface of said component which thus contacts said web-like surface portion of said overwrap and, (2) in the direction along said normal axis away from the other of said means for supporting and transporting to prevent excessive radial pressure on said component during said contact.

2. The apparatus defined in claim 1 further comprising:

means for applying adhesive to the exposed portion of at least one of said component and said overwrap prior to brining said component and said overwrap into contact with one another.

3. The apparatus defined in claim 1 further comprising:

means for rolling said component about its longitudinal axis after bringing said component and said overwrap into contact with one another to cause said overwrap to wrap around said component.

4. The apparatus defined in claim 3 wherein said means for rolling comprises:

first and second surfaces for receiving and engaging said component and overwrap therebetween; and means for moving said first and second surfaces relative to one another in a direction perpendicular to the longitudinal axis of said component while maintaining both of said first and second surfaces in engagement with said component and overwrap, at least one of said first and second surfaces being resilient in the direction mutually perpendicular to (1) the direction of relative motion of said first and second surfaces and (2) the longitudinal axis of said component to prevent excessive radial pressure on said component during wrapping of said overwrap around said component.

5. The apparatus defined in claim 1 wherein said means for supporting said overwrap has a concave flute parallel to the longitudinal axis of said component where the exposed portions of said component and said overwrap contact one another.

6. The apparatus defined in claim 5 wherein the radius of curvature of said flute is greater than the radius of curvature of the circumference of said component.

7. Apparatus for wrapping a smoking article component in a web-like overwrap so that at least one end of said component is precisely aligned with an edge of said overwrap, said apparatus comprising:

a stop;

means for bringing said end of said component into contact with said stop;

means for feeding said overwrap toward said component in a direction perpendicular to the longitudinal axis of said component;

means for slitting said overwrap parallel to said direction of feeding to produce said edge on one side of the slit, said means for slitting being aligned with said stop so that said edge is aligned with said end which is in contact with said stop; and means for bringing the slit overwrap into contact with said component and for rolling said component about its longitudinal axis to wrap said slit overwrap around said component.

8. The apparatus defined in claim 7 wherein said means for bringing said end of said component into contact with said stop comprises:

means for pushing on the end of said component remote from said stop.

9. The apparatus defined in claim 8 wherein said means for pushing is resilient parallel to the longitudinal axis of said component to prevent excessive axial pressure on said component when said component contacts said stop.

10. Apparatus for making smoking articles having at least one substantially cylindrical component having a longitudinal axis and a finite length, said component being radially relatively rigid but fragile and requiring circumferential wrapping with a web-like overwrap, which is separately supplied to said apparatus, said apparatus comprising:

means for supporting and transporting said component toward said overwrap in a direction perpendicular to the longitudinal axis of said component so that an axial portion of the outer surface of said component is initially exposed; and means for supporting and transporting said overwrap toward said component in a direction perpendicular to the longitudinal axis of said component so that (1) said overwrap is substantially planar, (2) the direction in which said overwrap is transported toward said component is substantially perpendicular to the plane defined by said overwrap, (3) at least a portion of one of the surfaces of said overwrap is initially exposed, sand (4) the initially exposed portions of said component and said overwrap initially contact one another as a result of said transporting of said overwrap toward said component, said means for supporting and transporting said overwrap having a concave flute parallel to the longitudinal axis of said component and perpendicular to the direction of travel of said component for supporting the surface of said overwrap opposite the initially exposed portion of said overwrap which initially contacts said component as a result of said transporting of said overwrap toward said component.

11. The apparatus defined in claim 10 wherein the radius of curvature of said flute is greater than the radius of curvature of the circumference of said component.

12. Apparatus for making smoking articles having a distal component and a proximal component comprising:

means for supplying a pair of said distal components so that their longitudinal axes are coaxial and so that their distal ends face toward one another;

means for wrapping each of said distal components with an overwrap by rolling the distal components about their longitudinal axes;

means for reversing the relative axial positions of said overwrapped distal components so that their longitudinal axes are again coaxial but so that their proximal ends face toward one another;

means for inserting a pair of proximal components between the facing proximal ends of said overwrapped distal components; and means for wrapping together each of said proximal components and the adjacent distal component with a tipping overwrap by rolling the proximal and distal components about their longitudinal axes.

13. The apparatus defined in claim 12 wherein said pair of proximal components is supplied as a unit and wherein said apparatus further comprises:

means for transversely bisecting said unit after said proximal and distal components have been wrapped with said tipping overwrap.

14. The apparatus defined in claim 12 wherein said means for wrapping each of said distal components with an overwrap comprises:

a stop interposed between the facing distal ends of said distal components;

the distal end of means for pushing each distal component into contact with said stop;

means for feeding said overwrap toward said distal components in a direction perpendicular to their longitudinal axes;

means for slitting said overwrap parallel to said direction of feeding, said means for slitting being aligned with said stop; and means for bringing the overwrap on each side of the slit into contact with the distal component on the respective side of said stop.

15. The apparatus defined in claim 14 wherein said means for pushing the distal end of each distal component into contact with said stop is resilient in a direction parallel to the longitudinal axes of said distal components.

16. The apparatus defined in claim 12 wherein said means for wrapping each of said distal components with an overwrap operates by contacting at least one axial portion of the surface of each distal component and is resilient in a direction perpendicular to the axial surface portion thus contacted.

17. A method for making smoking articles having at least one substantially cylindrical component having a longitudinal axis and a finite length, said component being radially relatively rigid but fragile and requiring circumferential wrapping with a separately supplied web-like overwrap, said method comprising the steps of:

supplying and transporting said component toward said overwrap in a direction perpendicular to the longitudinal axis of said component so that an axial portion of the outer surface of said component is initially exposed;

supplying and transporting said overwrap toward said component in a direction perpendicular to the longitudinal axis of said component so that at least a portion of one of the web-like surfaces of said overwrap is initially exposed and so that said initially exposed portions of said component and said overwrap are resiliently brought into initial contact with one another, the direction of resilience being normal to the portion of the outer surface of said component which contacts said web-like surface portion of said overwrap; and applying adhesive to the exposed portion of at least one of said component and said overwrap prior to resiliently bringing said component and said overwrap into contact with one another.

18. The method defined in claim 17 further comprising the step of:

rolling said component about its longitudinal axis after resiliently bringing said component and said overwrap into contact with one another to cause said overwrap to wrap around said component.

19. A method for wrapping a smoking article component in a web-like overwrap so that at least one end of said component is precisely aligned with an edge of said overwrap, said method comprising the steps of:

providing a stop;

bringing said end of said component into contact with said stop;

feeding said overwrap toward said component in a direction perpendicular to the longitudinal axis of said component;

slitting said overwrap parallel to said direction of feeding to produce said edge on one side of the slit, said slit being aligned with said stop so that said edge is aligned with said end which is in contact with said stop;

bringing the slit overwrap into contact with said component; and rolling said component about its longitudinal axis to wrap said slit overwrap around said component.

20. The method defined in claim 19 wherein said step of bringing said end of said component into contact with said stop comprises the step of:

resiliently pushing on the end of said component remote from said stop, the direction of resilience being parallel to the longitudinal axis of said component.

21. A method for making smoking articles having a distal component and a proximal component comprising the steps of:

supplying a pair of said distal components so that their longitudinal axes are coaxial and so that their distal ends face toward one another;

wrapping each of said distal components with an overwrap by rolling the distal components about their longitudinal axes;

reversing the orientations of said overwrapped distal components so that their longitudinal axes are again coaxial but so that their proximal ends face toward one another;

inserting a pair of proximal components between the facing proximal ends of said overwrapped distal components; and wrapping together each of said proximal components and the adjacent distal component with a tipping overwrap by rolling the proximal and distal components about their longitudinal axes.

22. The method defined in claim 21 wherein said pair of proximal components is supplied as a unit and wherein said method further comprises the step of:

cutting said unit transversely after said proximal and distal components have been wrapped with said tipping overwrap.

23. The method defined in claim 21 wherein said step of wrapping each of said distal components with an overwrap comprises the steps of:

interposing a stop between the facing distal ends of said distal components;

pushing the distal end of each distal component into contact with said stop;

feeding said overwrap toward said distal components in a direction perpendicular to their longitudinal axes;

slitting said overwrap parallel to said direction of feeding so that the resulting slit is aligned with said stop; and bringing the overwrap on each side of the slit into contact with the distal component on the respective side of said stop.

24. The method defined in claim 23 wherein said step of pushing the distal end of each distal component into contact with said stop comprises the step of:

resiliently pushing on the end of each distal component remote from said distal end, the direction of resilience being parallel to the longitudinal axes of said distal components.

25. The method defined in claim 21 wherein said step of wrapping each of said distal components with an overwrap comprises the step of:

resiliently engaging at least one axial portion of the surface of each distal component, the direction of resilience being normal to the axial surface portion thus contacted.

26. The apparatus defined in claim 1 wherein said means for supporting and transporting said component comprises a portion of the outer surface of a cylindrical drum which rotates about a central rotational axis, the longitudinal axis of said component being substantially parallel to the rotational axis of said drum.

27. The apparatus defined in claim 26 wherein said cylindrical drum comprises:

a core;

a flute resiliently mounted on said core so that said flute can move radially inward relative to said core; and means for holding said component to said flute.

28. The apparatus defined in claim 1 wherein said means for supporting and transporting said overwrap comprises a portion of the outer surface of a cylindrical drum which rotates about a central rotational axis which is substantially parallel to the longitudinal axis of said component.

29. The apparatus defined in claim 28 wherein the portion of the outer surface of said drum which is adjacent to the initially exposed portion of said overwrap defines a concave flute having a longitudinal axis which is substantially parallel to said central rotational axis.

30. The apparatus defined in claim 1 further comprising:

means for cutting said overwrap transversely into a segment of length needed to wrap around said component prior to contact between said component and said overwrap.

31. The method defined in claim 17 further comprising the step of:

cutting said overwrap transversely into a segment of length needed to wrap around said component prior to contact between said component and said overwrap.

32. Apparatus for making smoking articles having at least one substantially cylindrical component having a longitudinal axis and a finite length, said component being radially relatively rigid but fragile and requiring circumferential wrapping with a web-like overwrap which is separately supplied to said apparatus, said apparatus comprising:

first means for supporting said component;

second means for supporting said overwrap; and means for moving at lest one of said first and second means relative to the other of said first and second means so that an axial portion of the outer surface of said component is brought into initial contact with a portion of a web-like surface of said overwrap, said means for moving causing said at least one of said first and second means to move through an arc having a radius of curvature lying in a plane substantially perpendicular to the longitudinal axis of said component when said component initially contacts said overwrap, said radius of curvature extending from said at least one of said first and second means away from said other of said first and second means as said component is brought into initial contact with said overwrap, at least one of said first and second means being resilient at the location of said initial contact in a direction parallel to said radius of curvature to prevent excessive radial pressure on said component when said component initially contacts said overwrap.

33. Apparatus for making smoking articles having at least one substantially cylindrical component having a longitudinal axis and a finite length, said component being radially relatively rigid but fragile and requiring circumferential wrapping with a web-like overwrap which is separately supplied to said apparatus, said apparatus comprising:

first means for supporting said compound;

second means for supporting said overwrap; and means for moving at least one of said first and second means relative to the other of said first and second means so that an axial portion of the outer surface of said component is brought into contact with said overwrap, said means for moving causing said at least one of said first and second means to move through an arc having a radius of curvature lying in a plane substantially perpendicular to the longitudinal axis of said component when said component contacts said overwrap, said radius of curvature extending from said at least one of said first and second means away from said other of said first and second means as said component is brought into contact with said overwrap, said second means having a concave flute extending substantially parallel to the longitudinal axis of said component, said flute underlying said overwrap opposite said axial portion of the outer surface of said component when said component contacts said overwrap, the radius of said flute being greater than the radius of curvature of the outer surface of said component.

34. The method of making smoking articles having at least one substantially cylindrical component having a longitudinal axis and a finite length, said component being radially relatively rigid but fragile and requiring circumferential wrapping with a separately supplied web-like overwrap, said method comprising the steps of:

moving at least one of said component and said overwrap relative to the other of said component and said overwrap so that an axial portion of the outer surface of said component is brought into initial contact with a portion of a web-like surface of said overwrap, said moving step causing said at least one of said component and said overwrap to move through an arc having a radius of curvature lying in a plane substantially perpendicular to the longitudinal axis of said component when said component initially contacts said overwrap, said radius of curvature extending from said at least one of said component and said overwrap away from the other of said component and said overwrap as said component is brought into initial contact with said overwrap; and allowing at least one of said component and said overwrap to move resiliently parallel to said radius of curvature as said component initially contacts said overwrap to prevent excessive radial pressure on said component when said component initially contacts said overwrap.

35. Apparatus for making smoking articles having at least one substantially cylindrical component having a longitudinal axis and a finite length, said component being radially relatively rigid but fragile and requiring circumferential wrapping with a web-like overwrap which is separately supplied to said apparatus, said apparatus comprising:

a first substantially cylindrical drum having a first central axis about which said first drum is rotated, the substantially cylindrical surface of said first drum including first means for releasably holding said component to said first drum with the longitudinal axis of said component substantially parallel to said first central axis; and a second substantially cylindrical drum having a second central axis about which said second drum is rotated, the substantially cylindrical surface of said second drum including second means for releasably holding said overwrap to said second drum, said first and second central axes being substantially parallel to one another and laterally spaced from one another such that a nip is formed between the substantially cylindrical surfaces of said first and second drums, said first and second drums being rotated about their respective first and second central axes so that the substantially cylindrical surfaces of both drums approach said nip from the same direction and so that said component and a portion of a web-like surface of said overwrap initially contact one another when said component and said overwrap are brought together at said nip by rotation of said drums, at least one of said first and second means for releasably holding being resilient at the location of the initial contact between said component and said overwrap in a direction substantially parallel to a radial axis of the associated drum which extends to said at least one of said first and second means to prevent excessive radial pressure on said component as said component and said overwrap pass through said nip and initially contact one another.

36. The apparatus defined in claim 35 further comprising:

means for applying adhesive to at least one of said component and said overwrap prior to bringing said component and said overwrap into contact with one another at said nip so that said component and said overwrap adhere to one another after being thus brought into contact with one another.

37. The apparatus defined in claim 35 further comprising:

means for rolling said component about its longitudinal axis after bringing said component and said overwrap into contact with one another to cause said overwrap to wrap around said component.

38. The apparatus defined in claim 37 wherein said means for rolling comprises:

first and second surfaces for receiving and engaging said component and said overwrap therebetween; and means for moving said first and second surfaces relative to one another in a direction perpendicular to the longitudinal axis of said component while maintaining both of said first and second surfaces in engagement with said component and said overwrap, at least one of said first and second surfaces being resilient in the direction mutually perpendicular to (1) the direction of relative motion of said first and second surfaces and (2) the longitudinal axis of said component to prevent excessive radial pressure on said component during wrapping of said overwrap around said component.

39. The apparatus defined in claim 37 wherein said second means for releasably holding has a concave flute which extends parallel to said second central axis and which is adjacent to said component when said component passes through said nip.

40. The apparatus defined in claim 39 wherein the radius of curvature of said flute is greater than the radius of curvature of the cylindrical surface of said component.

41. Apparatus for making smoking articles having at least one substantially cylindrical component having a longitudinal axis and a finite length, said component being radially relatively rigid but fragile and requiring circumferential wrapping with a web-like overwrap which is separately supplied to said apparatus, said apparatus comprising:

a first substantially cylindrical drum having a first central axis about which said first drum is rotated, the substantially cylindrical surface of said first drum including first means for releasably holding said component to said first drum with the longitudinal axis of said component substantially parallel to said first central axis; and a second substantially cylindrical drum having a second central axis about which said second drum is rotated, the substantially cylindrical surface of said second drum including second means for releasably holding said overwrap to said second drum, said first and second central axes being substantially parallel to one another and laterally spaced from one another such that a nip is formed between the substantially cylindrical surfaces of said first and second drums, said first and second drums being rotated about their respective first and second central axes so that the substantially cylindrical surfaces of both drums approach said nip from the same direction and so that said component and said overwrap contact one another when brought together at said nip by rotation of said drums, the substantially cylindrical surface of said second drum having a concave flute which extends substantially parallel to said second central axis, said flute underlying said overwrap and being opposite said component when said component passes through said nip, the radius of curvature of said flute being greater than the radius of curvature of the outer surface of said component so that all portions of the surface of said second drum which may apply pressure to said component through said overwrap when said component passes through said nip are concave.

* * * * *